US005356031A

United States Patent [19]

Jondelius

[11] Patent Number: 5,356,031

[45] Date of Patent: Oct. 18, 1994

[54] DEVICE FOR SUPPORTING PAPER FOR COMPUTER PRINTERS

[76] Inventor: Björn Jondelius, Riviere, Tewkesbury Road, Cheltenham, Gloucestershire GL51 9SG, England

[21] Appl. No.: 984,576

[22] PCT Filed: Sep. 4, 1991

[86] PCT No.: PCT/SE91/00581

§ 371 Date: Mar. 3, 1993

§ 102(e) Date: Mar. 3, 1993

[87] PCT Pub. No.: WO92/04242

PCT Pub. Date: Mar. 19, 1992

[30] Foreign Application Priority Data

Sep. 5, 1990 [SE] Sweden ..... 9002830-9

[51] Int. Cl.[5] ..... B65D 90/08

[52] U.S. Cl. ..... 220/610; 220/6; 220/4.29; 280/79.2; 206/501

[58] Field of Search ..... 206/821, 503, 509, 501; 220/23.83, 23.86, 4.27, 4.29, 6, 666, 610, 611, 622, 625, ; 280/79.11, 79.2

[56] References Cited

U.S. PATENT DOCUMENTS

| | | | |
|---|---|---|---|
| 3,692,204 | 9/1972 | Provi et al. | 220/4.29 |
| 3,749,278 | 7/1973 | von Boch-Galhau | 206/501 |
| 4,167,271 | 9/1979 | Jorgensen | 280/79.2 |
| 4,314,649 | 2/1982 | Blomqvist | 220/4 F |
| 4,673,087 | 6/1987 | Webb | 206/503 |
| 4,768,893 | 9/1988 | Herbst | 400/613 |
| 4,789,130 | 12/1988 | Stich et al. | 220/23.83 |
| 5,186,330 | 2/1993 | McClure | 220/908 |

FOREIGN PATENT DOCUMENTS

| | | | |
|---|---|---|---|
| 0168885 | 1/1986 | European Pat. Off. . | |
| 8300321 | 2/1983 | PCT Int'l Appl. . | |
| 8900531 | 1/1989 | PCT Int'l Appl. . | |
| 1157654 | 7/1969 | United Kingdom . | |
| 2016420 | 9/1979 | United Kingdom | 220/4.29 |
| 2220193 | 1/1990 | United Kingdom . | |

*Primary Examiner*—S. Castellano
*Attorney, Agent, or Firm*—Nies, Kurz, Bergert & Tamburro

[57] ABSTRACT

A device for supporting printing paper for the printers of computers and computer terminals, the printing paper being present in the form of a stacked continuous paper web. The device includes an upwardly open box having a flat bottom part and upstanding side walls, the latter being removable from the bottom part, the bottom part being flat and rectangular and provided along two mutually opposing side edges with centrally positioned, longitudinally extending projections of which each extend from a respective side edge through a distance which corresponds to the thickness of the upstanding walls, and which projections are intended to directly support two of the vertical side walls which in turn support the other two vertical side walls.

3 Claims, 1 Drawing Sheet

DEVICE FOR SUPPORTING PAPER FOR COMPUTER PRINTERS

The present invention relates to a device for supporting printing paper for use with the printers of computers and computer terminals.

It is becoming more usual to equip each working location in an office with a computer, for instance a personal computer, or a computer terminal and a printer. The paper used in the printer is usually in the form of a continuous paper web. Such paper is delivered in boxes containing a large number of sheets, for instance 2,000 sheets. The box is therefore relatively heavy. Normally, the office personnel concerned place the boxes of paper beneath a table on which the printer is situated, and load the printer with paper from the box.

It is often awkward to push the boxes in beneath the table, while handling of the boxes at floor level involves body movements which place unfavourable strain on the person concerned. Furthermore, the boxes are aesthetically unattractive, particularly when the remaining office furniture has an attractive design. A further problem arises when a particular printer needs to be supplied with two or more different sorts of paper. In these cases, it is necessary to shift the boxes so that the box containing the paper required on that particular occasion is located on the floor immediately beneath the printer.

The present invention solves these problems in a simple and inexpensive fashion.

The present invention thus relates to a device for supporting paper for use with the printers of computers and computer terminals, this paper being stacked in a continuous paper web, and is characterized in that the device includes an upwardly open box having a flat bottom part and detachable walls upstanding from said bottom part; in that the bottom part of the box is provided with a centrally positioned, elongated projection along each of two mutually opposing side edges thereof, the two projections projecting from respective side edges through a distance which corresponds to the thickness of the upstanding walls; and in that the two projections are intended to directly support two of the vertical walls.

Figure 1:
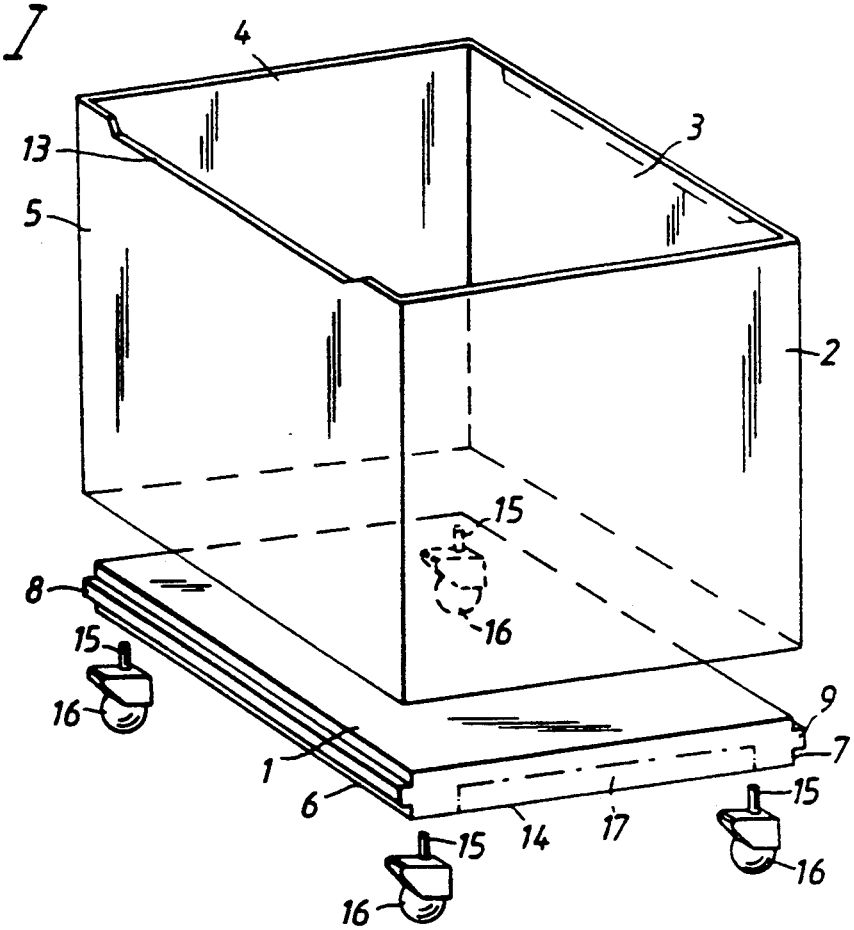
Figure 2:
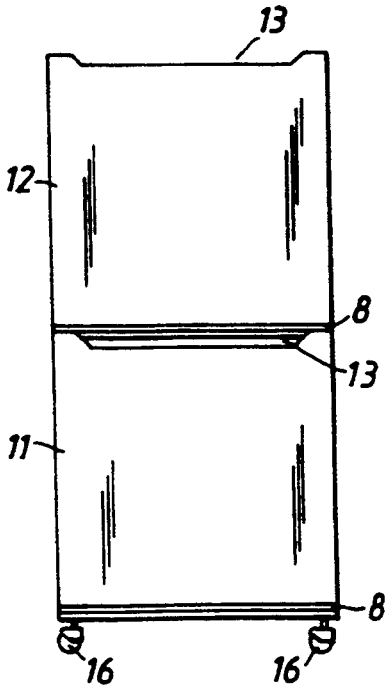

The invention will now be described in more detail, partially with reference to an exemplifying embodiment of the invention illustrated in the accompanying drawing, in which FIG. 1 is an exploded perspective view of the inventive device, with spaced apart components;

FIG. 2 is a side view of two devices stacked one upon the other; and

Figure 3A:
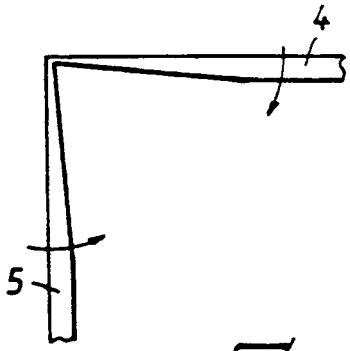
Figure 3B:
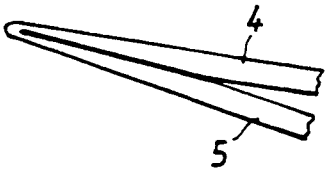

FIGS. 3*a* and 3*b* are detailed illustrations of one corner of the vertical walls, as seen from above.

FIG. 1 illustrates an inventive device for supporting paper for the printers of computers and computer terminals. Although the paper is not shown in the Figure, it will be understood that the paper has the form of a continuous web stacked in the device.

The device includes an upwardly open box structure having a flat rectangular bottom part 1 and detachable walls 2, 3, 4 and 5 which extend vertically upwards from the bottom part 1 of said box. Extending along each of two mutually opposing side edges 6, 7 of the bottom part 1 is a centrally positioned, longitudinally extending projection 8, 9 on which the walls 3 and 5 are intended to rest.

The device is produced from an appropriate plastic material.

The projections 8, 9 extend from respective parallel side edges 6, 7 of the bottom part 1 distance which corresponds to the thickness of the upstanding walls 2–5. The inner distance between two mutually opposing walls corresponds to the width of the bottom part above the projections 8, 9. Consequently, when the walls 2–5 are lifted onto the bottom part 1, the outer surfaces of the walls 3, 5 will coincide with the outer vertical surfaces of the projections 8, 9.

Because the projections are positioned centrally in a vertical direction relative to the edges 6 and 7 of the bottom part, a number of such devices can be stacked one upon the other. FIG. 2 shows a device 12 stacked on a device 11, wherein the upper surfaces of the walls of the bottom device 11 coact with the bottom part of the upper device 12.

According to one preferred embodiment, the upper edge of at least one of the upstanding walls 5 has formed therein a recess 13 which extends along the greater part of the length of the upper edge of said wall. The paper web is intended to slide in the recess, thereby enabling a paper web stacked in the bottom device 11 to be fed out to the printer despite the presence of the device 12 on top of the bottom device.

According to another preferred embodiment, at least one side, 14, of said bottom part is provided with a drill hole (not shown) at each of its four corners. These holes are intended to accommodate a castor pin 15 to which a wheel 16 is fastened, in a manner generally known per se.

Instead of drilling holes, wheels of the kind which have support brackets attached to the underneath of said bottom part with the aid of adhesive tape can be used.

According to one important embodiment from a packaging and storing aspect, the upstanding walls are formed as an integral unit. In this regard, the walls are arranged in a manner which enables the walls to be folded relative to one another, between a position in which the walls form a right-angled configuration and a position in which said walls form a flat rhomboidal configuration. This is illustrated in FIG. 3*a*, which illustrates a right-angled corner, and FIG. 3*b* which illustrates a pointed corner. In order to enable a flat rhomboid to be easily obtained, the thickness of the walls adjacent the corners is decreased towards said corners, as will best be seen from FIG. 3*a*.

Instead of forming the walls as an integral unit, the walls may be fastened to one another at their respective corners in some appropriate fashion, for example with the aid of known fittings such as clips attached to the bottom and top corners.

Because only two mutually opposing side edges of the bottom part are provided with projections 8, 9, only the walls 3 and 5 are directly supported by the bottom part 1, whereas the walls 2 and 4 are supported through their connection to the walls 3 and 5.

The advantage of providing solely the two projections 8, 9 on the opposite edges 6 and 7 of the bottom part 1 is that the bottom part can be produced by extrusion. This results in low manufacturing costs. In order to reduce the quantity of material used in producing the bottom part 1, and also the weight of said bottom part, the bottom part can be grooved during the extrusion process, for instance in accordance with the dash-dotted line 17 shown in FIG. 1, so that the bottom part will have a smaller thickness in its central part than at its edges.

When a box of paper or a stack of paper is to be placed on the upper surface of the bottom part, the readily removed walls of the device are first removed and then replaced when the paper is in position.

The wheels fitted under the bottom part of the device enable the device to be readily rolled from a place, for instance beneath a table, when the box can be replenished with paper.

Handling of printer paper is considerably simplified by the present invention, while the device is aesthetically attractive. Furthermore, several different types of paper can be stacked immediately beneath the printer, by stacking two or more devices one on the other.

Because the walls of the device can be folded in the aforedescribed manner, the device can be easily stored and transported while it has a small volume.

Although the inventive device has been described above with reference to various embodiments thereof, it will be understood that the device can be modified with regard to its structural design.

The invention is therefore not restricted to the aforedescribed embodiments thereof, since modifications can be made within the scope of the following claims.

I claim:

1. A device for supporting printing paper for the printers of computers and computer terminals, the paper being in the form of a stacked continuous paper web, said device comprising: an upwardly open box made from plastic material having a structurally integral, one piece, rectangular flat bottom part with upper and lower surfaces, the upper surface consisting of only a single rectangular plane and having no recesses, and two sets of opposed parallel side edges, one set of said two sets of opposed parallel side edges of the rectangular bottom part define two opposite side edges; said bottom part having longitudinally extending projections integral with and centrally projecting out only from each of the two opposite side edges of said one set and said projections being located on said edges centrally between said upper and lower surfaces and having a thickness, in the direction normal to the flat bottom part, which is less than the width of the bottom side edges; and a vertical box part with four substantially flat upstanding walls, each being of essentially rectangular shape with vertical edges attached to each other; said bottom part and said vertical box part being of independent construction and said box part being removably supported on the bottom part, only two opposite walls of said four walls being directly supported by their lower horizontal portions resting on said longitudinally extending projections which project out from said one set of two opposite side edges of the rectangular bottom part; and wherein at least one of the upstanding walls of the box part has provided, in its upper horizontal edge, a recess which extends along the major part of the length of said at least one upstanding wall and has a depth that is greater than half of the width dimension of the side edges of the bottom part minus half of the thickness dimension of said projections.

2. A device according to claim 1, wherein the four upstanding walls are a structurally integral unit which, when removed from said bottom part, is foldable between an erect boxlike position, in which the corners of the walls assume rightangled configurations, and a collapsed position, in which the walls assume a substantially flattened rhomboidical form in cross-section.

3. A device according to claim 1, further including a plurality of wheeled castors each having a castor pin, and wherein the flat rectangular bottom part, on at least one side thereof and adjacent each of its four corners is provided with a drill hole, each of which drill holes receives a castor pin of one of said plurality of wheeled castors.

* * * * *